US005152235A

United States Patent [19]

Goto et al.

[11] Patent Number: 5,152,235

[45] Date of Patent: Oct. 6, 1992

[54] SEWING APPARATUS FOR MANUFACTURING A TUBULAR PIECE

[75] Inventors: Hidetaka Goto; Tatsuo Sako, both of Ohno; Tatsuaki Kaneda, Suita, all of Japan

[73] Assignee: Pegasus Sewing Machine Mfg. Co., Ltd., Osaka, Japan

[21] Appl. No.: 702,300

[22] Filed: May 20, 1991

[30] Foreign Application Priority Data

Jul. 26, 1990 [JP] Japan ..... 2-198723

[51] Int. Cl.[5] ..... D05B 23/00

[52] U.S. Cl. ..... 112/63; 112/304; 112/320

[58] Field of Search ..... 112/10, 63, 121.11, 112/121.12, 121.15, 121.29, 147, 262.2, 303, 304, 307, 320

[56] References Cited

U.S. PATENT DOCUMENTS 2,546,527 3/1951 Smyth ..... 112/63 X
4,401,041 8/1983 de Polo ..... 112/63
4,413,580 11/1983 Moyer et al. ..... 112/262.2
4,856,444 8/1989 Brocklehurst ..... 112/10 X
4,865,309 9/1989 Beasock et al. ..... 112/121.11 X

FOREIGN PATENT DOCUMENTS 377301 10/1991 Japan .

*Primary Examiner*—Werner H. Schroeder
*Assistant Examiner*—Paul C. Lewis
*Attorney, Agent, or Firm*—Jones, Tullar & Cooper

[57] ABSTRACT

A sewing apparatus for forming cuffs for sweat jackets or anklets for sweat pants or the like. The apparatus includes a movable table carrying an end of an elastic tape continuous to a supply source. The tape advances on a carrying table to a cutting device where the tape is cut. The front end of the tape is transferred to gripping blades which can be inverted, simultaneously with the return movement of the movable table. The tape is further let out toward the gripping blades by a predetermined length feeding device and the gripping blades turn so that the tape front end is folded back on the tape rear part. The tape rear part is cut off and the folded cut-piece is supplied to a sewing machine by a conveying device automatically and sewn to join both ends along the cut line.

8 Claims, 11 Drawing Sheets

SEWING APPARATUS FOR MANUFACTURING A TUBULAR PIECE

BACKGROUND OF THE INVENTION

1. Field of the Invention

The present invention relates to a sewing apparatus for manufacturing a tubular piece made of knit fabric or other elastic material, such as a cuff and anklet sewn to, for example, sweat wear, jackets and sweat pants.

2. Description of the Prior Art

Hitherto, manufacturing such a tubular piece, was generally based on manual work, requiring cutting a long tape into a specific size, folding the cut tape in two in the widthwise direction to join the ends, leading the joined edges into the sewing part of the sewing machine while keeping the folded shape by the hand of the operator, and sewing. It took, accordingly, too much time and labor, resulting in poor productivity, thereby raising the cost of manufacture.

In light of the problems associated with the conventional manual work approach, a tubular piece manufacturing apparatus has been proposed which is capable of automating the procedure of the tubular piece manufacture. Such an apparatus is disclosed in Japanese patent application Hei. 1-19269.

The apparatus disclosed in this Japanese patent application comprises a leading-out device having an air cylinder with a long stroke for gripping the end portion of a long tape guided on a guide surface, and drawing out the long tape by a specified length; a pair of gripping pieces for holding the end portions of the long tape to shift it from the leading-out device; an inverting device for inverting the tape gripped part by the gripping pieces and overlaying on the long tape on the guide surface after the long tape is sent out to a specified length by a sending-out device; a cutting device for cutting the long tape so as to form an edge portion opposite to the edge portion of the tape folded back by the inverting device; and a conveying device for conveying the tape folded part formed by the cutting device so that the opposing edge portion may be led into the sewing part of the sewing machine sequentially.

The tubular piece manufacturing apparatus so constructed is capable of automating the work that took much time and labor in the conventional manual work approach, enhancing productivity and lowering the manufacturing cost. This apparatus proved very useful, but the following points still require improvement.

(1) The leading-out device has an air cylinder with a long stroke, and has a gripping device attached to the front end of the rod of the air cylinder, and the air cylinder is disposed to extend in the lengthwise direction of the guide surface.

Accordingly, the apparatus itself is long in the longitudinal direction, and is large in size, and requires a wide area for installation.

In addition, since the gripping device is attached to the front end of the rod, and the rod projects horizontally to grip the long tape, the gripping action may be unstable in the course of long use due to deflection at the front part of the rod and vibration or other effects. There is room for improvement in the durability aspect of the apparatus.

(2) By the sending-out device, the tape is sent out upon completion of the retraction action of the air cylinder after the inverting device returns to its initial state (the gripping pieces are open vertically in the forward position of the guide surface), only after the tape end portion held by the leading-out device is shifted to the gripping pieces.

Therefore, the number of tubular pieces manufactured per unit of time is limited by the time required for retraction of the air cylinder and the time required for the shifting action to the gripping pieces; and, in order to improve manufacturing efficiency, it is required to shorten these action times as much as possible.

(3) Since the conveying device passes before the sewing machine, it is necessary to install a guide shaft or other guide member at the front side of the sewing machine for reciprocal motion of this conveying device. This guide member, however, becomes an obstacle when serving the front part of the sewing machine.

SUMMARY OF THE INVENTION

The invention is intended to solve the above problems, and it is a primary object thereof to provide a manufacturing apparatus for manufacturing a tubular piece capable of enhancing productivity, reducing manufacturing cost, improving durability and reducing the size of the apparatus.

It is another object of the present invention to provide a manufacturing apparatus for manufacturing a tubular piece capable of easily serving the front part of the sewing machine.

In order to achieve the above objects, the present invention provides a sewing apparatus for manufacturing a tubular piece comprising:

a sewing machine;

a carrying table forming a conveying surface continuously disposed flush with a top surface of a sewing table of the sewing machine;

a movable table for transporting a long tape from a back position to a forward position on the carrying table and supporting the long tape with its front end projecting from a front edge of the movable table;

a predetermined length feeding device for feeding the long tape, the device being disposed at a front side of the carrying table;

an inverting device having a pair of gripping blades for folding back the long tape after the pair of gripping blades have gripped the front end of the long tape at the forward position of the movable table and the feeding device has fed a predetermined length of the long tape;

a cutting device for cutting a rear portion under the front end of the long tape to make a folded cut-piece after the gripping blades have folded back the long tape;

and a conveying device for conveying the folded cut-piece along the top surface and the conveying surface of the carrying table, toward the sewing machine by which edges of the folded cut-piece area are sewn and joined together.

According to the manufacturing apparatus for manufacturing a tubular piece as constructed above, as the movable table in the state of supporting the long tape moves from back to front, the front end portion of the long tape is inserted and gripped between the pair of gripping blades of the inverting device for folding back the tape, and the tape in a specified length is sent out by the action of the pre-determined length feeding device. The tape dispensing action by the feeding device may be carried out without having to wait until the movable table returns backward. Successively, the inverting device is put in action, and the tape is turned and folded over on the fixed table, and is cut in its widthwise direction by the cutting device, and both edge portions of the cut tape are joined together. The folded cut-piece is automatically fed into the sewing machine by the conveying device so that both edge portions may be sewn together.

Thus, according to the present invention, as the means for inserting the front end portion of a long tape into a pair of gripping blades of the inverting device, instead of the conventional leading-out means, a let-off means comprising a movable table moving back and forth and pair of gripping blades for inserting the front end portion of the long tape when the moving table moves forwarded is employed, so that timing the start of tape feeding after gripping of the front end portion of the long tape by the gripping blades may be set in the midst of the returning stroke of the movable table. Accordingly it is possible to fold back the tape by the inverting device earlier than in the prior art, and the manufacturing time may be shortened, and together with the automation for cutting and folding the tape, productivity may be notably improved, while the manufacturing cost may be reduced.

In addition, according to the present invention, it is proposed to support the long tape on the movable table in its forward stroke, and insert and grip the tape end projecting from the front edge of the movable table between the gripping blades, so that the tape end is gripped securely, and the gripping will not be unstable in the course of long use, thereby enhancing the durability of the apparatus. Moreover, since the long stroke cylinder as in the prior art is not needed, the longitudinal length of the apparatus may be cut short, and the apparatus may be downsized.

In the manufacturing apparatus for manufacturing a tubular piece according to the present invention, the conveying device consists of a pressure conveying device and a belt conveying device, and the pressure conveying device presses the folded cut-piece of the tape against the top surface of the fixed table, and conveys the folded cut-piece toward the sewing machine. The belt conveying device comprises pulleys and a endless belt supported with the pulleys, the endless belt serving to run in the conveying direction of the pressure conveying device in an abutting state against the lower side of the presser foot of the sewing machine.

According to this arrangement of the present invention, i.e., where the conveying device for conveying the folded cut-piece toward the sewing machine comprises the combination of the pressure conveying device and the belt conveying device, the front space of the sewing machine is free from obstructions, and maintenance of the front part of the sewing machine may be done easily without interference from the conveying device.

In another embodiment of the present invention, a tape stock device is provided in order to stock the long tape in a slack state, located slightly behind the movable table when it is located at the retreat position.

In such a construction, too, application of excessive tension on the long tape is prevented as far as possible when the movable table moves forward or when the long tape is sent out by the predetermined length feeding device, so that tubular pieces of uniform quality may be obtained.

Other objects and effects of the present invention will be better understood and appreciated from the following detailed description of the embodiment taken in conjunction with the drawings.

DETAILED DESCRIPTION OF THE PREFERRED EMBODIMENTS

Figure 1:
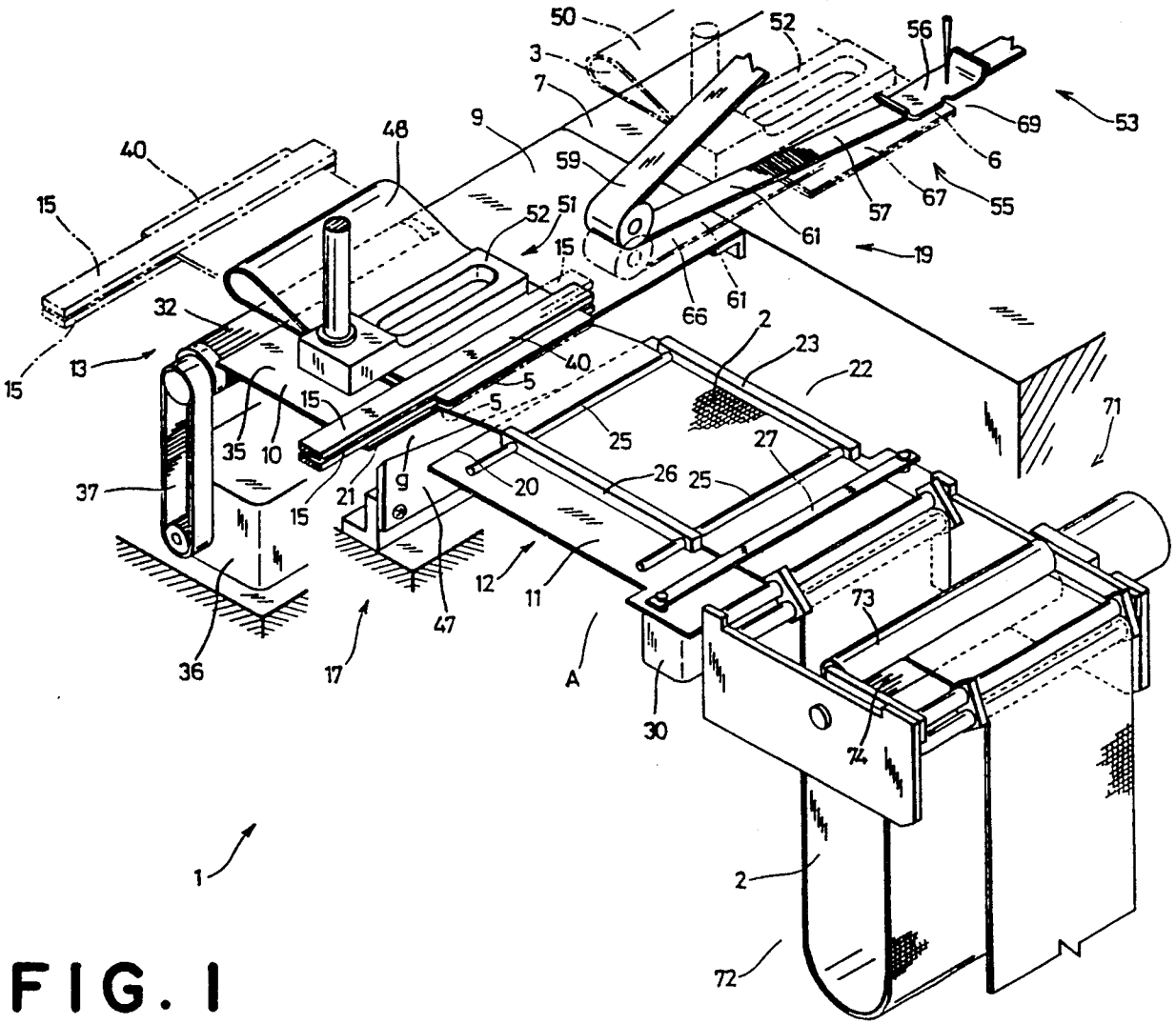
FIG. 1 is a schematic perspective view showing an embodiment of a manufacturing apparatus according to the present invention for manufacturing a tubular piece.

Referring now to the drawings, one of the embodiments of the invention is described in detail below.

In FIG. 1 a general view of the structure is shown, a tubular piece manufacturing apparatus 1 of the present invention is designed to cut a long tape (for example, a tape made of knit fabric or elastic material) 2 to a specific length, join both ends of the cut tape 3, and sew the joined edge portion 6, which comprises: a carrying table 10 forming a conveying surface 9 flush with and continuous to a top surface 7 of a sewing table for a sewing machine 53; a movable table 12 movable back and forth slightly above the carrying table 10 and supporting the long tape 2 on a top surface 11; a pre-determined length feeding device 13 (see FIG. 3) of long tape disposed at the front side of the carrying table 10; an inverting device 16 (see FIGS. 2 to 4) for folding back the tape possessing a pair of gripping blades 15, 15 opening and closing for gripping the front end portion of the long tape 2 in the stationary state being installed ahead of the feeding device 13; a cutting device 17 for cutting the long tape 2 to a specific length; and a conveying device 19 for conveying a folded cut-piece toward the sewing machine 53. It is more specifically described below.

The movable table 12 has its top surface 11 formed nearly as a horizontal plane as shown in FIGS. 1 and 6 to 8, and slightly above the carrying table 10. It is designed to move longitudinally between the backward position A (see FIG. 6) and the forward position B (see FIG. 7) covering the carrying table 10. In the backward position A, there is a gap g between the front edge 20 of the movable table 12 and a rear edge 21 of the carrying table 10. The device for moving the movable table 12 is not shown in the drawing, but with a guide hole disposed at the base end of the lower surface of the movable table 12 which is penetrated by a guide shaft extending in the moving direction of the table 12, the movable table 12 is guided and moves back and forth along the guide shaft depending on the expansion and contraction of the rod of an air cylinder (not shown).

On the table top surface 11, there is a tape guide 22 (see FIG. 1) which abuts against both side edges of the long tape 2 fed thereon. The tape guide 22 comprises a fixed guide plate 23 fixed at one side on the table top surface 11, and a movable guide plate 26 supported slidably on guide shafts 25, 25 projecting in the widthwise direction of the table top surface 11 at the front end and rear end of the fixed guide plate 23. Depending on the width of the long tape 2 fed on the table top surface 11, the intervals of both guide plates 23 and 26 are adjusted, and designed so that the long tape 2 may pass between the table top surface 11 and the guide shafts 25, 25. At the rear end, for example, of the movable table 12, there is a pressure bar 27 extending in the widthwise direction above the table top surface 11 capable of gripping the long tape 2 with the table top surface 11. Both ends of the pressure bar 27 are fixed to the top ends of rods projecting from an air cylinder 30 fixed at both ends of the lower side of the rear end of the movable table 12, and when the rods of the air cylinder 30 are in an extended state, a gap is formed between the pressure bar 27 and the table top surface 11 to allow the long tape 2 to pass, and as the rods contract, the pressure bar 27 presses the long tape 2, so that the long tape 2 is gripped between the table top surface 11 and the pressure bar 27.

Figure 6:
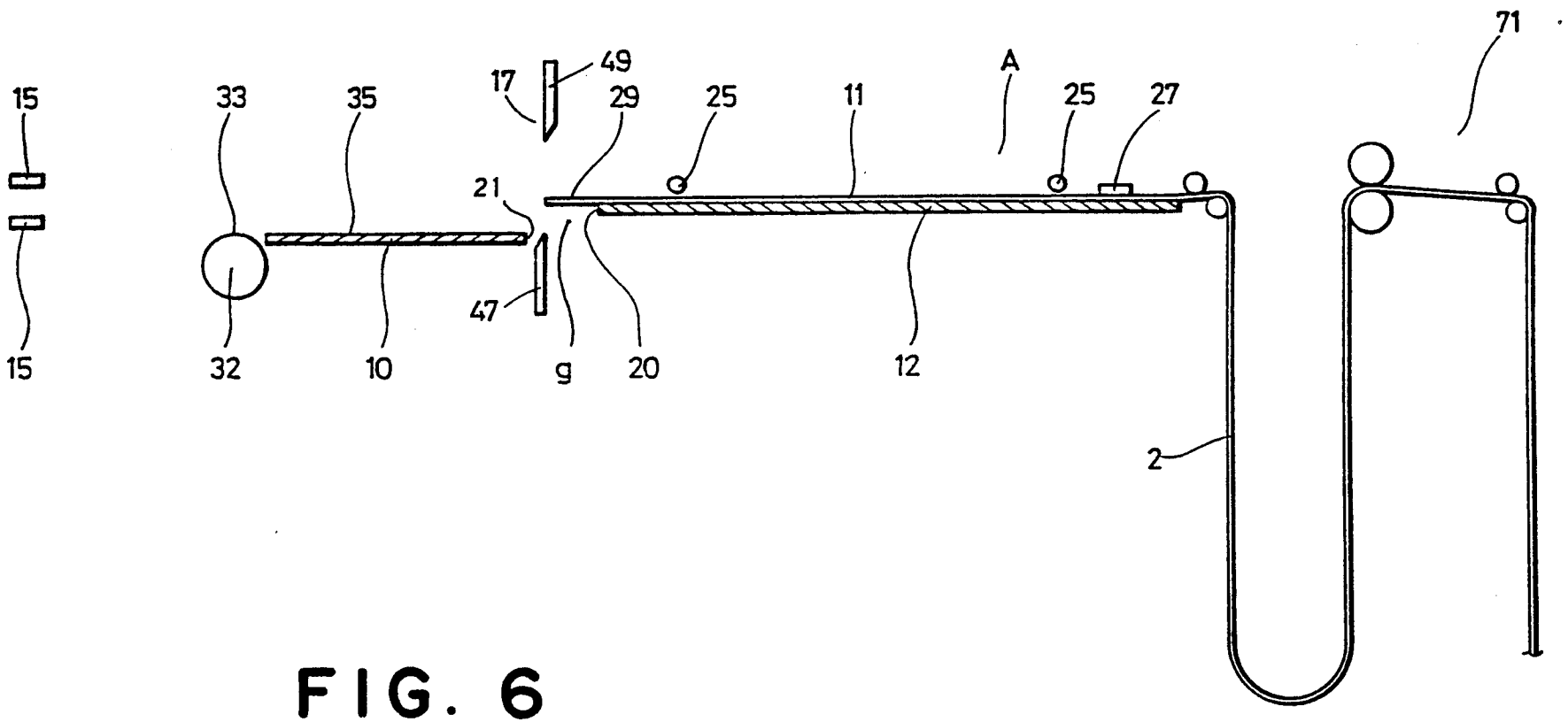
FIGS. 6 to 11 are schematic side views sequentially showing the operation of the manufacturing apparatus for manufacturing a tubular piece according to the present invention.
Figure 7:
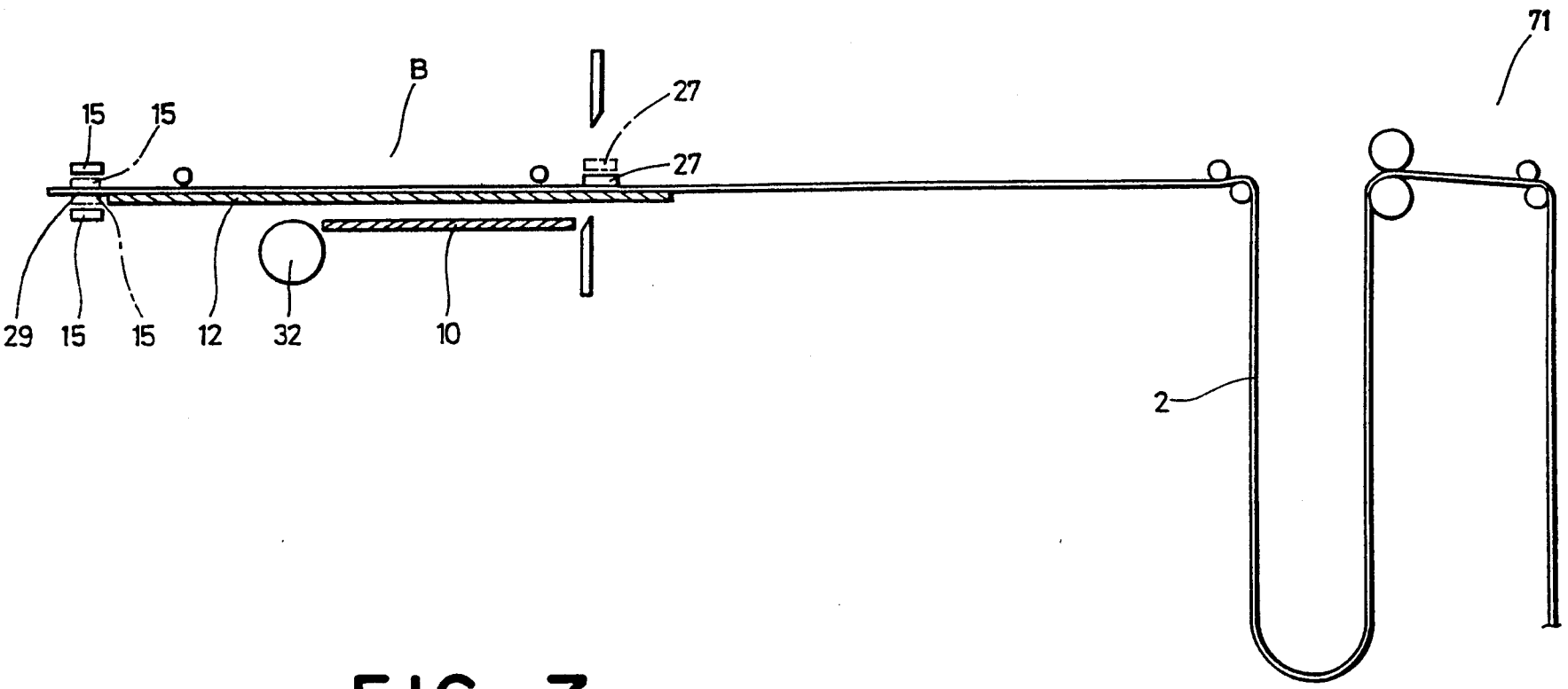
Figure 8:
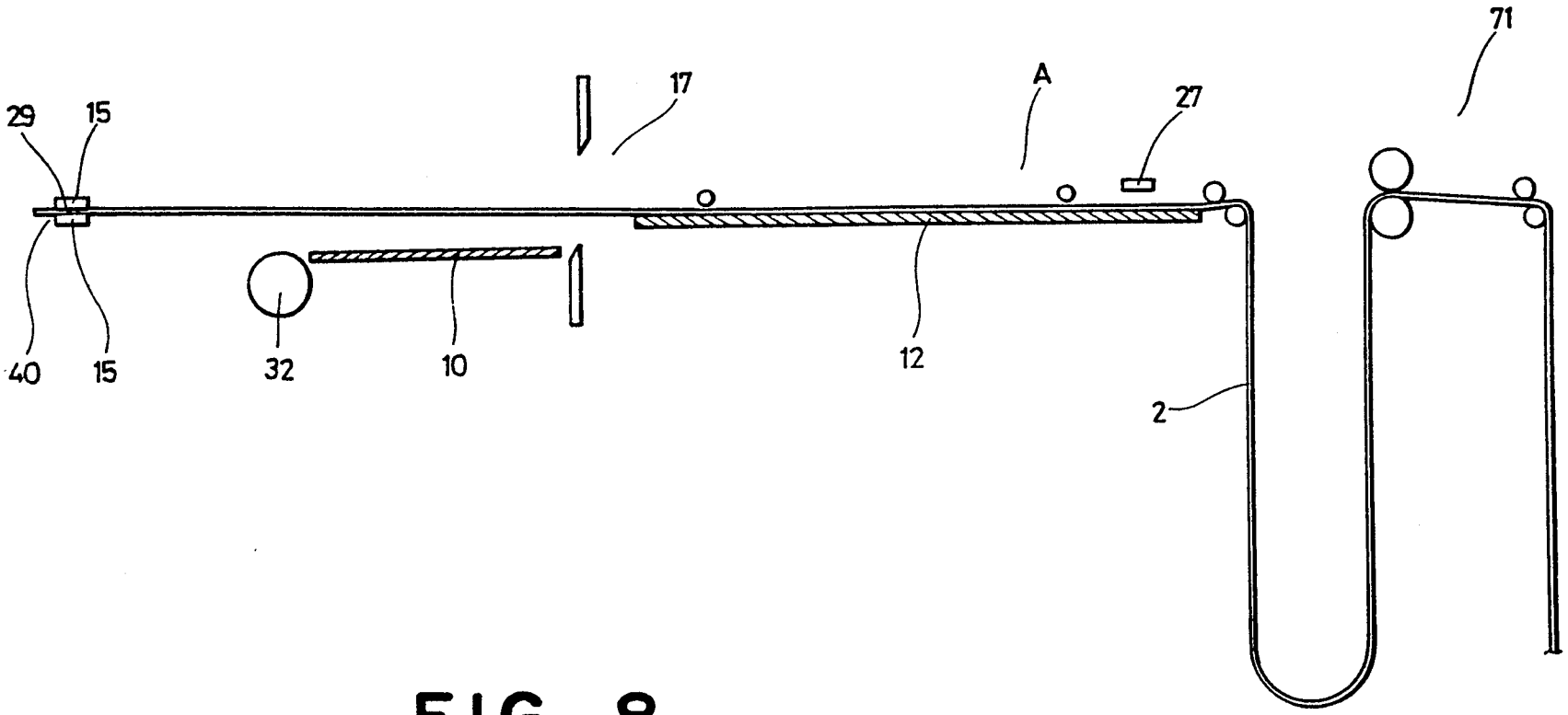

The pressing time of the pressure bar 27, and the moving time of the movable table 12 are set as follows. That is, prior to movement of the movable table 12 from the backward position A to the forward position B, as shown in FIG. 6, the long tape 2 is supported on the table top surface 11 under the guide shafts 25, 25 and the pressure bar 27, and extends out from the front end 20 of the movable table 12 at its front end portion to form a tape protrusion 29, and in this state the pressure bar 27 lowers to grip the long tape 2 together with the table top surface 11. As shown in FIG. 7, the movable table 12 moves to the forward position B to insert the tape protrusion 29 between gripping blades (mentioned later) 15, 15 and to grip it by gripping blades 15, 15 as indicated by the single dot chain line. After the gripping blades 15, 15 grip the protrusion 29, the pressure bar 27 is raised to release the long tape 2, and the movable table 12 returns to the backward position A as shown in FIG. 8. After sending out a specific length by the predetermined length feeding device 13 as mentioned in detail below, the pressure bar 27 grips the long tape 2 again as indicated by the single dot chain line in FIG. 9, to be ready for the next forward action of the movable table 12.

The pre-determined length feeding device 13 comprises an upper roller 31 and a lower roller 32 for gripping the long tape 2 between the rollers 31, 32 after the tape gripping state by the pressure bar 27 is released, while both gripping blades 15, 15 grip the tape protrusion 29. In this embodiment, the lower roller 32 is a driving roller, and this lower roller 32 is pivoted on the machine bed along the front edge of the carrying table 10, so that the roller top surface 33 of the lower roller 32 may be roughly flush with the table top surface 35 of the carrying table 10 (see FIG. 6), and it is rotated by driving of a step motor 36 through a timing belt 37. The upper roller 31 is disposed in the upper position in parallel to the lower roller 32, and is rotatably supported on a bearing member 39 disposed at the rod front end of the air cylinder, not shown, which expands and contracts in the vertical direction. By expansion of the air cylinder, the long tape 2 is gripped between the upper roller 31 and lower roller 32, and as the lower roller 32 is rotated by the driving of the step motor 36, the long tape 2 is extended by a specific length toward a tape gripping device 40 carried ahead of the carrying table 10. Meanwhile, the long tape extended length by the feeding device 13 is defined by a digital display device not shown herein, depending on the size of the tubular piece to be manufactured.

Figure 2:
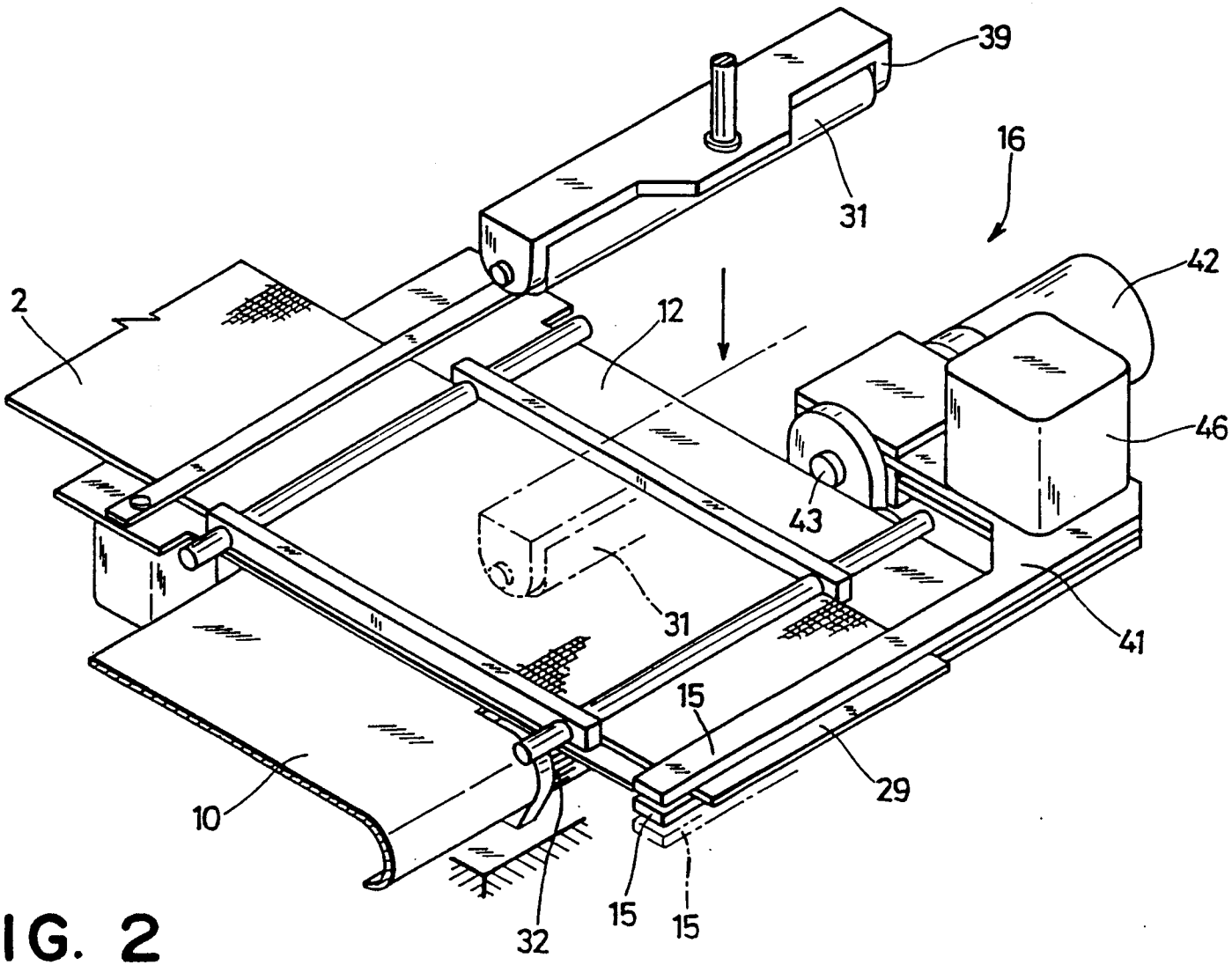
FIG. 2 is a perspective view of essential parts showing the gripping state of the projecting portion of the long tape by gripping blades of the inverting device as the movable table moves forward.
Figure 3:
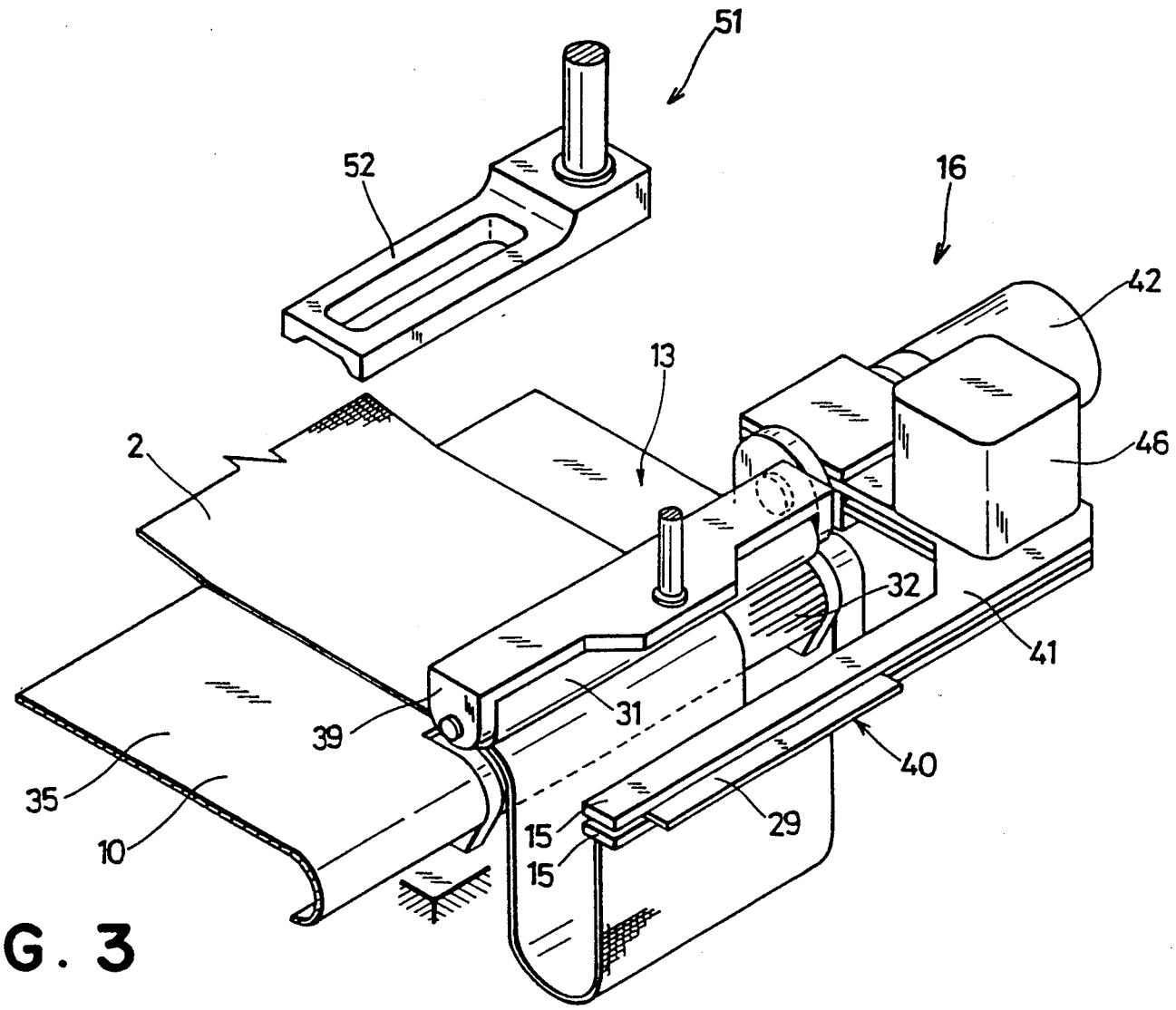
FIG. 3 is a perspective view of essential parts showing the sending out state of the long tape by a specific length by the predetermined length feeding device.
Figure 4:
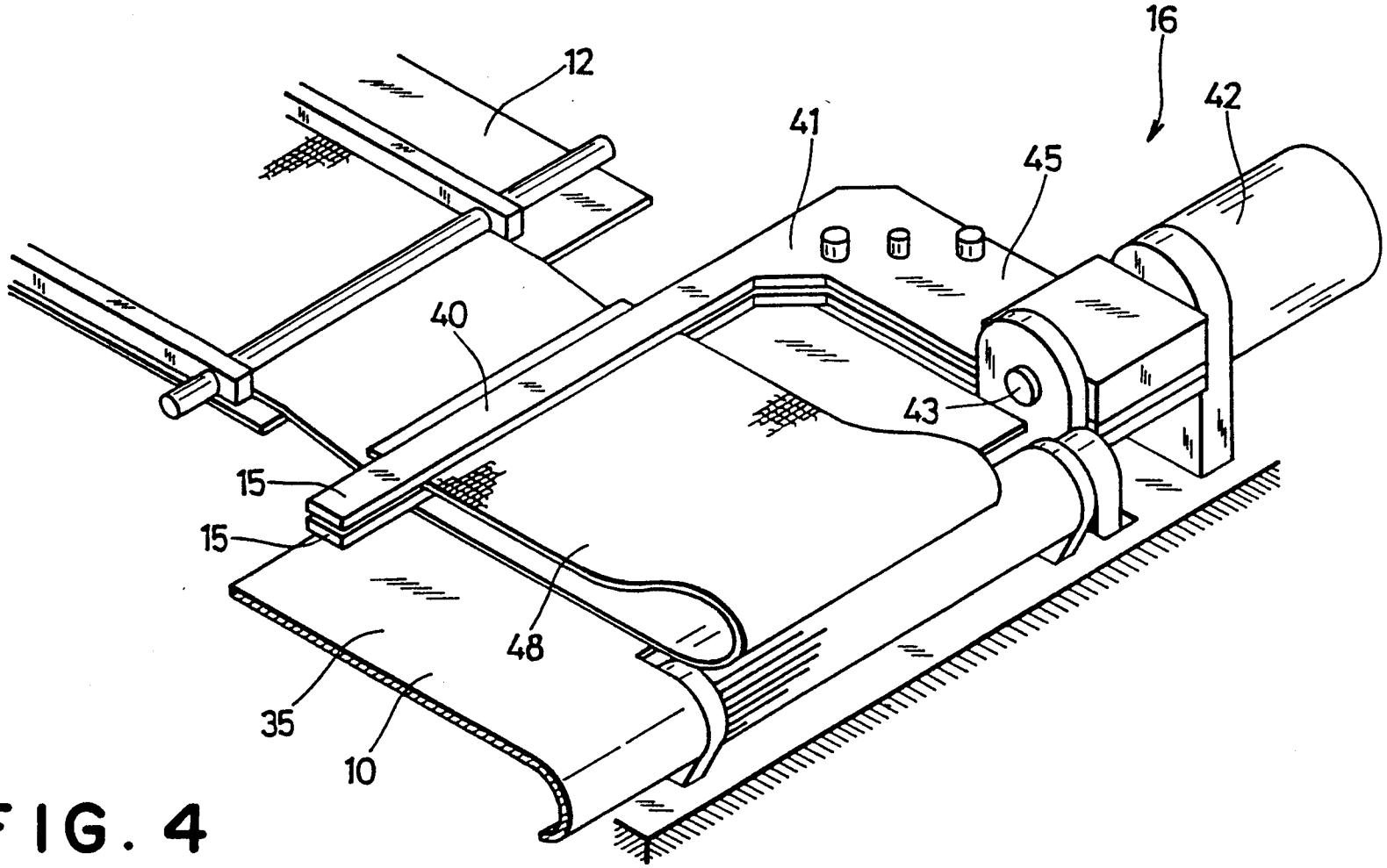
FIG. 4 is a perspective view of essential parts showing the forming state of the tape folding part by the inverting device.
Figure 10:
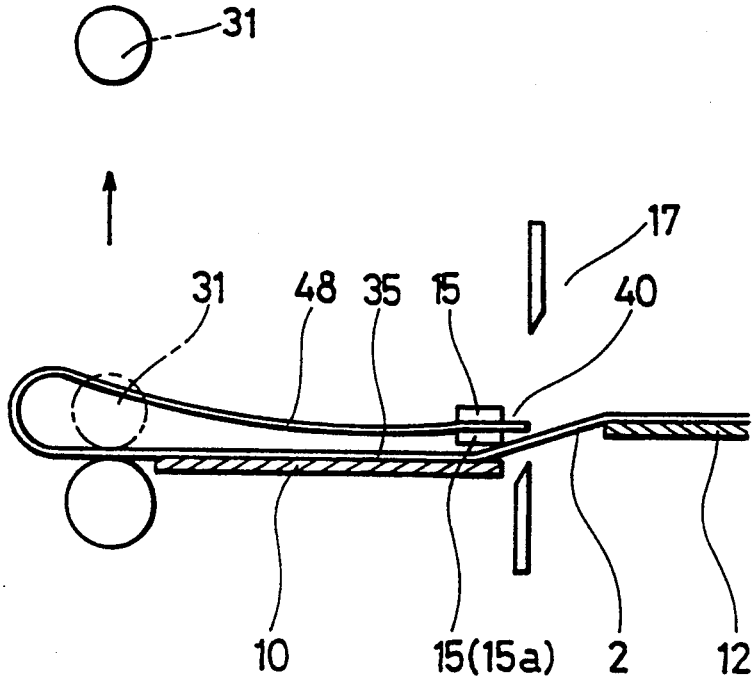
Figure 11:
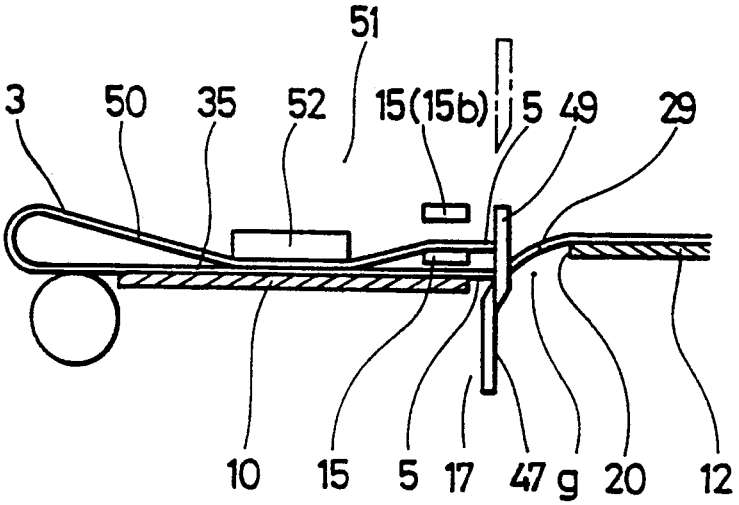

The inverting device 16 can be installed ahead of the feeding device 13 as shown in FIGS. 2 to 4, and the gripping device 40 having a pair of upper and lower gripping blades 15, 15 for gripping the tape protrusion 29 in its overall width is disposed at the end of an arm part 45 fixed to the rotary shaft 43 of a reduction gear motor 42 attached to the machine bed. The opening and closing action of the upper and lower gripping blades 15, 15 is effected by expansion and contraction of an air cylinder 46. The inverting device 16 is designed to invert the tape gripping blades 15, 15 so that a folding portion 48 of the long tape 2 may be formed on the carrying table 10 by rotating the arm part 45 by about 180 degrees as shown in FIG. 4, by driving the reduction gear motor 42 after sending out the tape by the feeding device 13 after gripping the tape protrusion 29 by the upper and lower gripping blades 15, 15. In this embodiment, meanwhile in order to avoid interference of the conveyance of a folded cut-piece 50 as mentioned later as far as possible, in the inverted state of the tape gripping device 40, the lower gripping blade 15*a* is designed to be slightly lifted from the carrying table top surface 35 as shown in FIG. 10, and right after the pressure conveying device 51 presses the folding portion 48 to the table top surface 35, the upper gripping blade 15*b* is lifted as shown in FIG. 11, so that the tape gripping state by the gripping blades 15, 15 may be released.

The cutting device 17 is located in the gap g portion formed between the front edge 20 of the movable table 12 in the backward position A and the rear edge 21 of the carrying table 10, and as shown in FIG. 6, it is composed of a stationary cutter 47 fixed on the machine bed and a movable cutter 49 moving up and down in the vertical direction with respect to the stationary cutter 47. In this embodiment, as shown in FIG. 11, when the pressure conveying device 51 presses the folding portion 48 to the table top surface 35, the movable cutter 49 descends, thereby cutting the long tape 2 in its widthwise direction. By this cutting, the folded cut-piece 50 is formed as an independent piece from the long tape 2, and a tape protrusion 29 projecting from the front edge 20 of the movable table 12 is formed at the same time.

Figure 5:
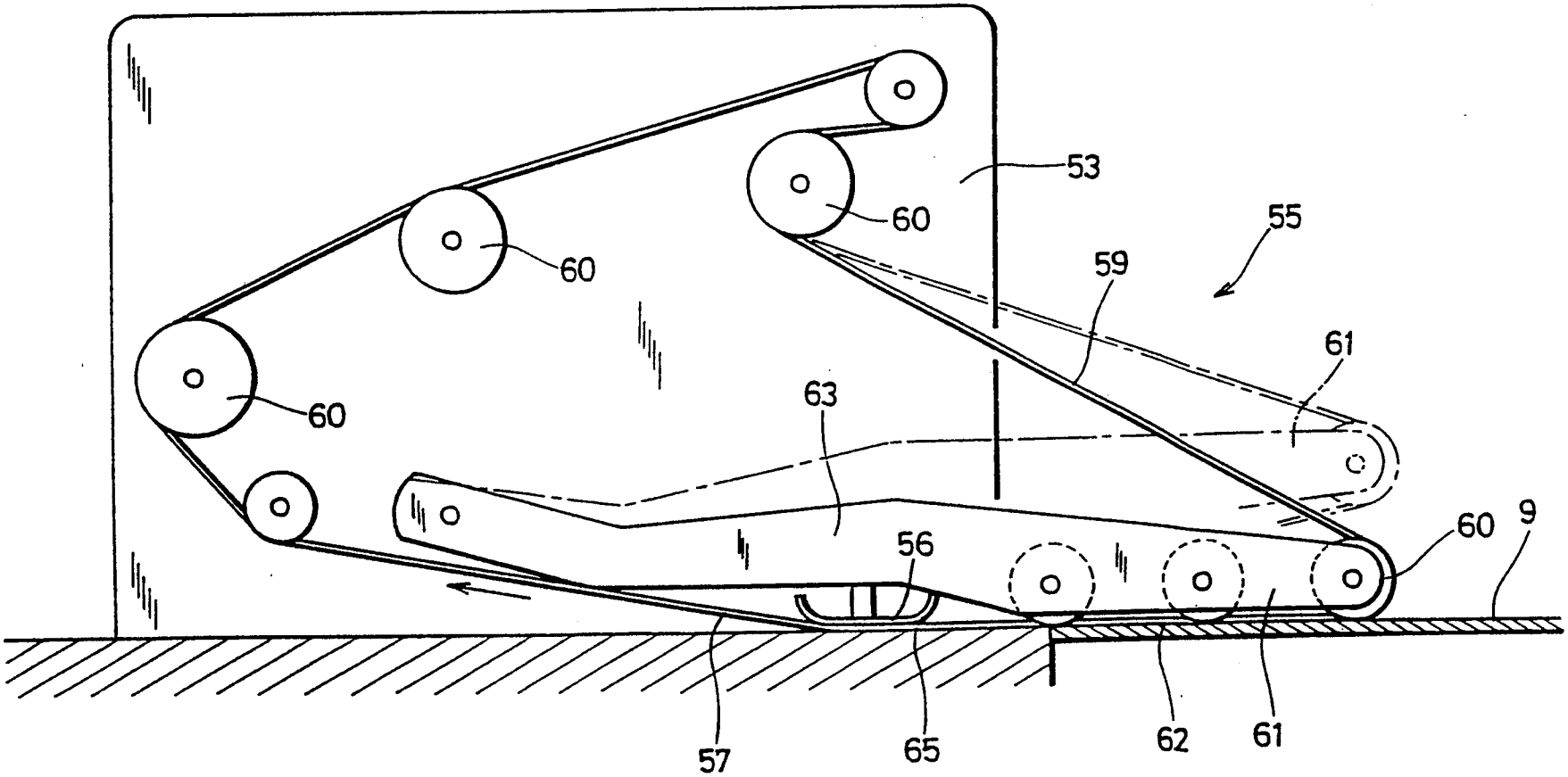
FIG. 5 is a side view of essential parts for explaining the belt conveying device together with its operation.

The pressure conveying device 51 composing the conveying device 19 is designed to press the middle part of the folding portion 48 of the folded cut-piece 50 toward the carrying table top surface 35 by the pressure member 52 as shown in FIG. 1, and the folded cut-piece 50 as an independent piece formed by cutting by the cutting device 17 is conveyed toward a sewing machine 53. A belt conveying device 55 forming a part of the conveying device 19 is formed, as shown in FIGS. 1 and 5, by winding the conveying belt 59 forced to turn so that the lower running part 57 may run in the conveying direction of the pressure conveying device 51 in the abutting state against the lower surface of a presser foot 56 of the sewing machine 53, around the pulley 60 properly disposed on the peripheral portion of the front part of the sewing machine. The front leading part 61 of the belt conveying device 55 is tiltable vertically about the end portion of the leading side of the presser foot 56 of the sewing machine, by the rotary motion of the arm 63, between the state of the lower surface 62 of the belt 59 abutting against the conveying surface 9, and the state of being lifted apart from the conveying surface. By lifting the front leading part 61, in a leading space 66 formed against the conveying surface 9, the edge portion 67 of the folded cut-piece 50 conveyed by the pressure conveying device 51 is inserted as indicated by the single dot chain line in FIG. 1. After insertion of the folded cut-piece 50, the front leading part 61 is inclined downward, and the edge portion 67 of the folded cut-piece 50 is gripped between the conveying belt 59 and the conveying surface 9, and by the subsequent belt turning, the folded cut-piece 50 is conveyed so that the overlapping edge portion 6 may be sequentially led into the sewing part 69 of the sewing machine 53. The pressure conveying device 51 is retracted to an upward and backward position by the contraction of the air cylinder, not shown herein, to wait for the next conveying operation after inserting the edge portion 67 of the folded cut-piece 50 into the leading space 66 so that the edge portion 67 may be gripped between the conveying belt 59 and the conveying surface 9.

Along with the conveyance by the belt conveying device 55, the sewing machine 53 sequentially sews the overlap edge portion 6 of the folded cut-piece 50. When the sewing of each piece is over, as the thread is cut off by the thread cutter attached to the sewing machine 53, a tubular piece 70 is manufactured, and this tubular piece is discharged from the sewing table 7 by proper discharge means.

In manufacturing apparatus so constructed of a tubular piece, when operated as described below, a tubular piece forming cuff or anklet may be automatically manufactured.

In the first place, the movable table 12 supporting the long tape 2 begins to move forward from the backward position A to the forward position B. The long tape 2 in the supported state by the movable table 12 in this operation is as shown in FIG. 6, the front end portion projects from the front edge 20 of the movable table, and the long tape 2 is held by the pressing action of the pressure bar 27. Meanwhile, projection of the long tape is, in the first stage of manufacture of a tubular piece, effected by, for example, mounting the long tape on the movable table and projecting a proper length by manual operation. After the second stage of manufacture, it is automatically formed by the tape cutting operation of the cutting device 17.

When the movable table 12 supporting the long tape 2 reaches the forward position B as shown in FIG. 7, the tape protrusion 29 is inserted between the vertically opened gripping blades 15, 15.

The inserted tape protrusion 29 is gripped in its overall width, as indicated by the single dot chain line in FIG. 7, by the gripping action of the gripping blades 15, 15.

After this gripping, the tape gripping state of the pressure bar 27 is cleared as shown by the single dot chain line (see FIG. 7), and the movable table 12 returns to the backward position A as shown in FIG. 8.

Figure 9:
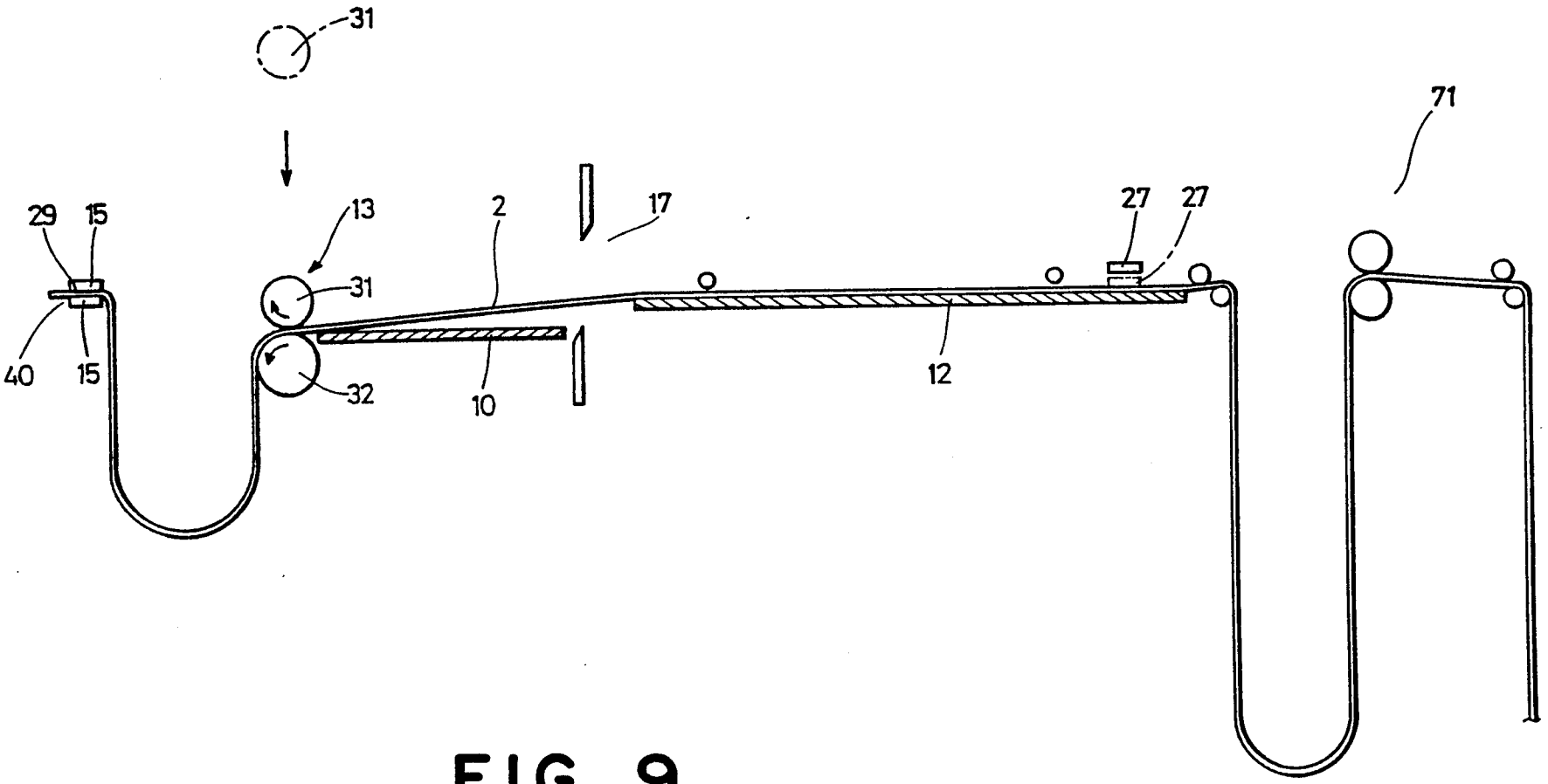

When both gripping blades 15, 15 grip the tape protrusion 29 and the tape gripping state by the pressure bar 27 is cleared, as shown in FIG. 9, the upper and lower rollers 31, 32 of the predetermined length feeding device 13 grip the long tape 2. As the driving roller 32 is rotated by the driving of the stepping motor, the long tape 2 is sent out by a specified length toward the tape gripping device 40. The tape send-out action by the feeding device 13 is effected not after waiting until the movable table 12 returns to the backward position A. The pressure bar 27, after sending out the tape, presses the long tape 2 again as indicated by the single dot chain line in FIG. 9, to be ready for next forward action.

In this way, after the long tape 2 is sent out, as shown in FIG. 10, the gripping blades 15, 15 of the tape gripping device 40 is inverted so as to overlay on the long tape 2 on the carrying table 10 by the inverting action of the inverting device 16.

After the gripping blades 15, 15 turn, as shown in FIG. 11, in the gap g between the front and rear tables, the long tape 2 is cut off in the widthwise direction by the cutting device 17. By this cutting, the folded cut-piece 50 having approximately opposing edge portions 5, 5 is formed, while the tape protrusion 29 is formed at the same time.

Thus composed the folded cut-piece 50 is conveyed by the conveying device 19 so that the overlaid edge portion 6 may be led into the sewing part 69 of the sewing machine 53, sequentially along the conveying surface 9 of the carrying table 10 (see FIG. 1). In particular, when the conveying device 19 comprises the pressure conveying device 51 and the belt conveying device 55, the pressure conveying device 51 presses the folding portion 48 toward the carrying table top surface 35, and the folded cut-piece 50 formed by the subsequent tape cutting is conveyed toward the sewing machine 53, and the edge portion 67 of the folded cut-piece 50 is led into the leading space 66 formed by lifting of the front leading part 61 of the belt conveying device 55. By the subsequent downward tilting of the front leading part 61, the edge portion 67 of the folded cut-piece 50 is gripped between the conveying belt 59 and the conveying surface 9, and by the subsequent belt turning, the folded cut-piece 50 is conveyed so that the overlaid edge portion 6 may be sequentially led into the sewing part 69 of the sewing machine. By such a conveying action of the conveying device, the overlaid edge portion 6 of the folded cut-piece 50 is sequentially sewn. At the end of sewing, as the thread is cut off by the thread cutter attached to the sewing machine, the intended tubular piece is manufactured.

In this embodiment, in order to obtain a tubular piece of uniform quality by ultimately preventing application of excessive tension on the long tape when sending out the long tape by the forward motion of the movable table or the predetermined length feeding device, as shown in FIG. 1, between the movable table at the backward position A and tape source, there is disposed a tape stock device 71 for stocking the long tape of proper length in a slack state. This device 71 comprises an idle roller 73 and a driving roller 74 for sequentially letting off the long tape 2 drawn out from the tape source, into the tape stock unit 72 for a length depending on the send-out of the predetermined length feeding device or forward motion of the movable table.

What is claimed is:

1. A sewing apparatus for manufacturing a tubular piece, comprising:

a sewing machine having a top surface;

a carrying table having a rear edge and forming a conveying surface continuously disposed flush with a top surface of a sewing table of the sewing machine;

a movable table having a top surface and a front edge, said movable table serving to transport a long tape from a back position to a forward position on the carrying table, the long tape having a front end and said carrying table having a front side and supporting the long tape with the front end projecting from the front edge of the movable table;

a predetermined length feeding device for feeding a predetermined length of the long tape, said predetermined length feeding device being disposed at the front side of the carrying table;

an inverting device having a pair of gripping blades for folding back the long tape after the pair of gripping blades have gripped the front end of the long tape at the forward position of the movable table, said predetermined length feeding device having the predetermined length of the long tape fed thereto;

a cutting device for cutting a rear portion of the long tape under the front end of the long tape to make a folded cut-piece after the gripping blades have folded back the long tape; and a conveying device for conveying the folded cut-piece along the top surface of the sewing machine and the conveying surface of the carrying table, toward the sewing machine, wherein edges of the folded cut-piece area are sewn and joined together.

2. A sewing apparatus for manufacturing a tubular piece as defined in claim 1, further wherein the movable table further has a pressure bar for gripping the long tape against the top surface of the movable table, the front end of the long tape projecting from the front edge of the movable table being inserted between the pair of gripping blades of the inverting device as the movable table moves forward while gripping the long tape by the pressing action of the pressure bar, and the pressure bar releases the long tape and the movable table moves backward after the projecting front end is gripped by the gripping blades.

3. A sewing apparatus for manufacturing a tubular piece as defined in claim 2, further wherein the predetermined length feeding device comprises a step motor, an upper roller and a lower roller for gripping the long tape between the rollers in a widthwise direction, after the projecting front end is gripped by the gripping blades and the tape gripped by the pressure bar is released, and one of said rollers being rotated by the step motor to send out the long tape by the predetermined length toward the tape gripping blades.

4. A sewing apparatus for manufacturing a tubular piece as defined in claim 1, further wherein the inverting device further has means for opening the pair of gripping blades and closing the gripping blades to grip the front end of the long tape after the front end of the long tape has been inserted between the pair of gripping blades by said movable table, and means for turning the pair of gripping blades around a horizontal axis to fold back and overlay the long tape on the conveying surface of the carrying table after the front end of the long tape has been gripped by said pair of blades.

5. A sewing apparatus for manufacturing a tubular piece as defined in claim 1, further wherein a gap portion is formed between the front edge of the movable table in the back position and the rear edge of the carrying table, and wherein said cutting device is located at the gap.

6. A sewing apparatus for manufacturing a tubular piece as defined in claim 1, further comprising a tape stock device for stocking the long tape in a slack state, the tape stock device being disposed at a position between the movable table and a tape source.

7. A sewing apparatus for manufacturing a tubular piece as defined in claim 1, further wherein the conveying device comprises a pressure conveying device and a belt conveying device, the pressure conveying device serving to press the folded part of the tape folded by the inverting device against the top surface of the carrying table, and convey the folded cut-piece toward the sewing machine, and the belt conveying device comprising pulleys and an endless belt supported by the pulleys, the endless belt adapted to run in the conveying direction of the pressure conveying device in abutment against the lower side of a pressor foot of the sewing machine.

8. A sewing apparatus for manufacturing a tubular piece as defined in claim 7, further wherein the endless belt has a lower belt running part and a bottom surface of the front leading portion of the lower belt running part is changed over between a state of nearly abutting against the conveying surface and a state of being lifted from the conveying surface by the vertical tilting around the end part of the leading side of the pressor foot, and wherein, along with the lifting of the front leading portion of the lower belt running part, in the leading space formed against the conveying surface, the edge portion of the folded cut-piece conveyed by the pressure conveying device is inserted, and the edge portion of the folded cut-piece is gripped between the endless belt and the top surface of the sewing table by the downward tilting after insertion.

* * * * *